United States Patent [19]

Haneda et al.

[11] Patent Number: 5,036,367

[45] Date of Patent: Jul. 30, 1991

[54] COLOR IMAGE FORMING APPARATUS

[75] Inventors: Satoshi Haneda; Hisashi Shoji; Kunihisa Yoshino, all of Hachioji, Japan

[73] Assignee: Konica Corporation, Tokyo, Japan

[21] Appl. No.: 406,849

[22] Filed: Sep. 13, 1989

Related U.S. Application Data

[63] Continuation of Ser. No. 268,160, Nov. 7, 1988, abandoned.

[51] Int. Cl.[5] ..... G03G 15/01; G03G 15/08

[52] U.S. Cl. ..... 355/260; 355/326; 355/327

[58] Field of Search ..... 355/326, 327, 245, 260

[56] References Cited

U.S. PATENT DOCUMENTS 4,515,462 5/1985 Yoneda ..... 355/326
4,587,536 5/1986 Saito et al. ..... 355/326 X
4,599,285 7/1986 Haneda et al. ..... 355/326 X
4,682,880 7/1987 Fujii et al. ..... 355/327
4,746,951 5/1988 Hayakawa et al. ..... 355/327 X
4,754,301 6/1988 Kasamura et al. ..... 355/326 X

FOREIGN PATENT DOCUMENTS 59-79264 5/1984 Japan ..... 355/326

*Primary Examiner*—A. C. Prescott
*Attorney, Agent, or Firm*—Frishauf, Holtz, Goodman & Woodward

[57] ABSTRACT

An image-forming apparatus of the electrophotographic type. Color images are made while also enabling formation of a sharp black image formed by utilizing a set of color toner development units, at least one of which is replaceable by a black toner development unit when black toner is required. This results in a simpler, more compact, and effective image-forming apparatus.

12 Claims, 7 Drawing Sheets

COLOR IMAGE FORMING APPARATUS

This application is a continuation of application Ser. No. 07/268,160, filed Nov. 7, 1988, now abandoned.

BACKGROUND OF THE INVENTION

This invention is related to an image forming technique of the electrophotographic type and, in particular, to providing color images and a sharp black image made separately by developers with a simple, compact image forming apparatus.

Monochromatic image forming apparatus which use the latest electrophotographic technology is described in Japanese Patent Publication Open to Public Inspection (hereinafter referred to as Japanese Patent O.P.I. Publication) No. 2433/1976 as having an electro-static charger, a photosensitive body and cleaning devices integrated into a replaceable process unit. This has contributed to making image forming apparatus compact, and has improved its reliability.

Also by exchanging developing devices having different color toners (U.S. Pat. No. 4,097,139) with the use of the above mentioned process units, a technique has been developed to enable one image forming apparatus to make copies in a selected mono-color.

As an extension of this concept, the application of the above mentioned method to a color image formation may be considered. According to the concept expressed in Japanese Patent O.P.I., Publication No. 72159/1983, processing components other than those which are a part of the transfer means of a conventional analog color image forming apparatus are integrated into a unit. By exchanging a process unit having a color toner with one having a black toner, a black image forming process is converted to a color image forming process.

However, in a color image forming apparatus, as indicated in Japanese Patent O.P.I. Publication No. 72159/1983, where a transfer means performs, transfer process for each of several colors, since a high degree of accuracy is required between the transfer means and a photosensitive drum, it is thought that a process unit having no transfer means has reliability problems. Consequently, the present development is moving in the direction of unitizing and miniaturizing individual processing components as shown by a rotary-type developing device (Japanese Patent O.P.I. Publication No. 2600073/1985).

In contrast to the above, it is known that a full-color electro-photographic image forming apparatus that does not use such an elaborate transfer means or rotary type developing device as stated above comprises a charger, image exposure means, three units of adjacently arranged developing devices respectively accommodating yellow(Y), magenta(M), and cyan(C) toners, and transfer means adjacent a photosensitive drum. While the photosensitive drum makes three turns, a color image is formed with sequential Y, M, and C toner images each of which is transferred to a transfer material.

If one tries to form a black image using such an image forming apparatus, however, dislocation occurs at exposure, or color imbalance occurs in the development process caused by the preceding toner image, eventually producing a redish or bluish black, and failing to produce a sharp black image Likewise, it is difficult to obtain a sharp image in black in a transfer method (Japanese Patent O.P.I. Publication No. 2600073/1985.) that develops a same latent image using toners Y, M, and C while a photosensitive drum makes one turn. This is primarily due to the fact that a toner image adhering to a photosensitive drum, in turn, influences exposure transmissivity when a following toner image is to be formed, or affects a potential in a development process.

To cope with this problem, a developing device accommodating black toner is added for forming a black image. This, however, causes the image forming apparatus to become larger. In addition to this, if developing devices containing Y, M, C and black are used, the black toner consumption becomes generally greater, posing the problem of frequent toner replenishment.

Moreover, there is a growing need for easy and sure conversion from mono-color such as black color image development to full color image development using yellow, magenta, and cyan toners. Subsequently, some modifications on a drive system in a main body of an image forming apparatus, bias and other electric input/output signal connections and their improvement have become necessary.

SUMMARY OF THE INVENTION

The present invention is made on the basis of the above mentioned background to provide a compact image forming apparatus capable of forming full color and sharp black images. This invention has achieved a configuration which is much smaller than the transfer drum system, whose mechanism is more complex and transfer registration is difficult, by repeating development in individual colors on a image forming means, and by summarily transferring a superimposed color toner image to a transfer material.

In addition to miniaturization, this invention has unitized at least a section including a developing device to simplify and ensure conversion between a configuration for forming a full color image and another one for forming a black image, while at the same time maintaining a proper image quality. The present invention has also been designed to replace a group of developing devices for multiple color toners with a developing device having a large amount of black toner or to replace only a specified color developing device of the above mentioned color developer group with a black toner developing device, giving them good interchangeability. This invention has effective developed the commonly used drive and electrical input/output terminals by matching a sleeve position of the black toner developing devices to that of any one of multiple color toner developing devices to be replaced with the former.

Moreover, unlike the conventional color image forming apparatus using a transfer drum system, this invention by switching to the black image forming configuration (process), provides the device with a control that enables production of a longer black image (or a single mono-color) than that of a circumferential length of a photosensitive drum. This invention has improved user operabilities by unitizing not only the developing devices but photosensitive drum, cleaning device, and electro-static charger as well for mutual interchangeability.

In particular, this invention has enabled interchangeability between the black toner developing device, which has integrated (unitized) photosensitive drum and cleaning device, and the yellow toner developing device among yellow, magenta, and cyan which are all needed for full color development. The yellow toner developing device has also unitized the sensitized material and the cleaning device.

While black toner is used frequently, the photosensitive drum in the unit for yellow developing device is used less frequently. Therefore, the latter may be used separately, and the black toner unit may be abolished when black toner is used up.

Furthermore, as another embodiment, an image forming apparatus switches an image forming mode in response to an operation that each unit is inserted or removed, ensuring the production of flawless images. Moreover, when a power switch is turned ON, the most frequently used mode is set in accordance with a kind of the process unit currently being set on the device, thus improving usability.

The present invention has made it possible to inhibit the full color mode once the unit containing the black toner developing device is set on the device.

Furthermore, this image forming, apparatus automatically switches the filter installed in the optical path for image reading to neutral or to a green filter by the setting motion of black toner developing device or the unit containing it.

An image forming apparatus in accordance with one aspect of the present invention comprises a photosensitive body, an electro-static charger adjacent the photosensitive body, an image exposure means for detecting an original image and forming a corresponding electrostatic image on a charged surface of the photosensitive body, multiple developing means having respective multiple color toners to produce a toner image for the electrostatic image obtained with the image exposure means for at least one color of the multiple color toners, and a transfer means for transferring the toner image onto a transfer material. The multiple developing means comprises a plurality of first developing means respectively placed in an installed position for storing the multiple color toners, second developing means for storing a black toner, and means for selectively placing the second developing means in the installed position of at least one of the plurality of first developing means.

This invention is characterized by a capability for switching a configuration where there are provided developers for multiple color toners, for example, three developing devices containing yellow (Y), magenta(M), or cyan(C) toner, which forms a color image by synthesizing superimposing toner images of Y, M, and C while the photosensitive drum revolves three times, to another configuration where there is provided a developing device containing black toner in the position of the above mentioned three developing devices which forms and transfers a black toner image while a photosensitive drum revolves around once.

Another aim of this invention is to provide the device with a compact configuration through the switching of developing devices. Another, aim is to provide an easy way of mode selection after the developing devices are exchanged. To achieve these aims, the image forming apparatus wherein it is possible to exchange developing devices that develop static latent image on the photosensitive drum is configured so that the setting motion of the developing device after an exchange of developing device will automatically select a specific image forming mode which is set up with the individual developing devices in advance.

In addition to miniaturization of the device through the exchange of developing devices, it is a further aim of this invention to provide protection against an erroneous operation in mode selection after the exchange of developing device. To achieve this aim, the, image forming, apparatus which exchanger developing devices that develop static latent image on the photosensitive drum is configured to inhibit the selection of a mode for color-image formation by the setting motion of a developing device containing black toner, as it replaces a developing device containing another color toner.

In addition to miniaturization of the device through the exchange of developing devices, it is a further aim of this invention to provide a way for automatically exchanging color separation filters used on the image-reading device.

To achieve this aim, there is an image-forming apparatus which enables the exchange of developing devices which develop a static latent image formed on the photosensitive drum. The image reading device reads the original image through a filter and provides an output signal after changing the read image into image information. The signal image forming apparatus is configured to select a neutral filter in response to a setting motion of developing device containing black toner as it is set on the device as the result of the exchange of developing devices.

BRIEF DESCRIPTION OF THE DRAWING

FIG. 1 shows a color-image forming apparatus of this invention wherein one of multiple developers (or multiple developing devices) is configured to be replaceable with another developer (developing device).

FIG. 2 shows a preferred embodiment wherein a unit comprising multiple developers and a unit for a developer of single-type toner are made mutually exchangeable, in particular, the sleeve position of the single color toner developer is made to match that of multiple color developers.

FIG. 3 and FIG. 4 show the preferred configuration wherein a process unit integrates photosensitive drum and multiple developers to be exchangeable with another process unit having a photosensitive drum and only a single color-toner developer.

FIG. 4 shows a variation of embodiment of FIG. 3 wherein only a specific developer of multiple color-toner developers is configured into a process unit integrated with the photosensitive drum while the remainder of color developers remain on the main body.

FIG. 5 and FIG. 6 correspond with FIG. 1 and FIG. 2 showing the embodiments: a cleaning device, charging device, photosensitive drum and developer are integrated into a unit which can be loaded on the main body; a specific developer of multiple developers or all of them can be inserted on the unit - such developers are mutually exchangeable.

FIG. 7 to the configuration shown by FIG. 4, and is similar to that of FIG. 5 and FIG. 6; a process unit comprising a photosensitive drum and a developer can be loaded to the main body.

FIG. 8 shows the central sectional view of the complete color image forming apparatus of this invention with an original reading unit installed on top thereof.

FIG. 9 shows an enlarged outline of developer of the color image forming apparatus of the present invention.

FIG. 10 is a block diagram showing the control circuits of the image forming apparatus shown in FIG. 1.

FIG. 11 shows the front view, showing the filters for color separation in the image forming apparatus of this invention.

DETAILED DESCRIPTION OF THE INVENTION

Figure 1:
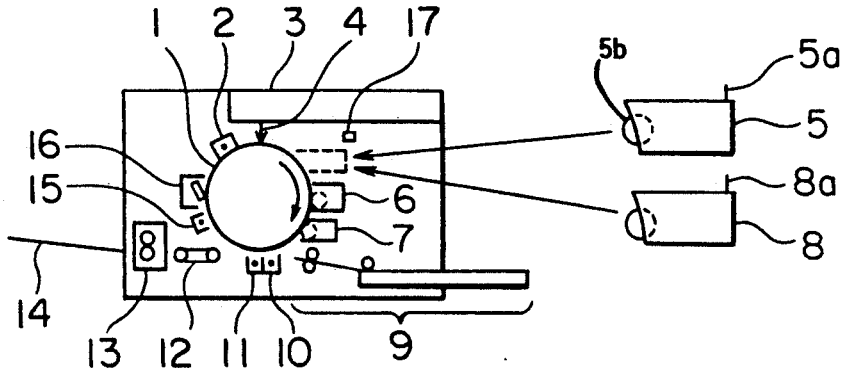
FIG. 1 through FIG. 11 show a color image forming apparatus of the preferred configuration according to this invention.

The preferred configurations of the invention will now be explained by way of example with reference to the accompanying diagrammatic drawings in which:

FIG. 1 through FIG. 4 are schematic , diagrams showing examples of an image forming apparatus according to this invention.

In these figures, numeral 1 indicates a photosensitive drum having an organic semiconductor and other photoconductive layers; 2 indicates an electro-static charger that uniformly charges the surface of photosensitive drum 1 revolving in the direction of an arrow; 3 indicates a scanner-type image exposure device using blue (B), green (G), red (R), and ND filters by switching or a laser, LED, LCS type image exposure device that outputs images on the basis of image data input from a Charge Coupled Device (CCD) applied color image sensor and other reading units; 4 indicates image exposure of line or dot type forming an electrostatic image through the incidence of rays of light from the image exposure device 3 at the charged surface of the photosensitive drum 1; numerals 5, 6, 7, and 8 indicate the developers that develop the electro-static image on the photosensitive drum 1 to Y, M, C, and black toner images respectively using Y, M, C, and black toners as the developing agent; 9 indicates a means for feeding transfer material; 10 indicates a transfer unit that transfers a toner image formed on the photosensitive drum 1 to the transfer material fed by the means 9; 11 indicates a separator that separates the material having a transferred toner image from the photosensitive drum; 12 indicates a conveyance means for feeding a separated transfer material to a fiXing unit 13; 14 indicates a delivery tray that receives transfer material fixed with toner image by the fixing unit 13; 15 indicates a pre-cleaning discharger for making the removal of residual toner on the photosensitive drum 1 after toner image transfer easier; and 16 indicates a cleaning unit that removes residual toner from the surface of photosensitive drum 1.

It is better for developers 5 to 8, particularly developers 5 to 7, to form and convey onto the developing sleeve (such as **5*b* for developer 5) a layer of toner thinner than the clearance between the developing sleeve and photosensitive drum 1, and to develop images by sending toner flying out of the layer of toner to the electro static image on the photosensitive drum to be attached there under a non-contact development condition. This method enables development without disturbing the toner image preformed on photosensitive drum 1**; also the developing state and non-operating state can be switched easily by changing the bias voltage application to the developing sleeve, and no shifting of developers is required for switching them.

The image forming apparatus in FIG. 1 is an example of the device configuration for the present invention. When developer 5 having yellow toner is set at the developer installation position shown by the dotted line, detection part **5*a* of developer 5 is detected by electrical or mechanical sensor 17. This changes the image forming apparatus to the color image forming mode. If the developer 8 having black toner is installed at the position enclosed by the dotted line, detection part 8*a* of developer 8 is detected by sensor 17 and the image forming apparatus changes to the mono-color image forming mode. In the color-image forming mode, photosensitive drum 1, for example, forms a Y-toner image on the charged surface in the first image forming rotation as the result of incidence of light rays from image exposure 4 correspondent with yellow image data and development by developer 5. During the second rotation, a M toner image is formed on the charged surface at the identical position as the result of the incidence of light rays from image exposure 4, correspondent with magenta image data, and the development by developer 6. On the third rotation, a C toner image is formed on the charged surface at the identical position as the result of incidence of light rays from image exposure 4, correspondent with cyan image data, and the development by developer 7. A color image created by the synthesis of Y, M, and C toner images formed on photosensitive drum 1** is then transferred to the transfer material to be fixed.

In the processes thus far described, transfer unit 10, separator 11, pre-cleaning discharger 15, and cleaning unit 16 are set at the inoperative state until transfer is completed. Moreover, in the mono-color image forming mode, photosensitive drum 1 forms a black toner image as one example for the mono-color on the charged surface in the first image forming rotation as the result of incidence of light rays from image exposure 4, correspondent with mono-color image data, and the development by developer 8, and the toner image is transferred to the transfer material for fixing before the photosensitive drum enters the second rotation. In this case the cleaning unit 16 is always kept in an operative state.

It is better for developer 8 having black toner to be exchanged with the one having yellow toner as the other mono-color development print functions of the magenta and cyan toner are still available.

Figure 2:
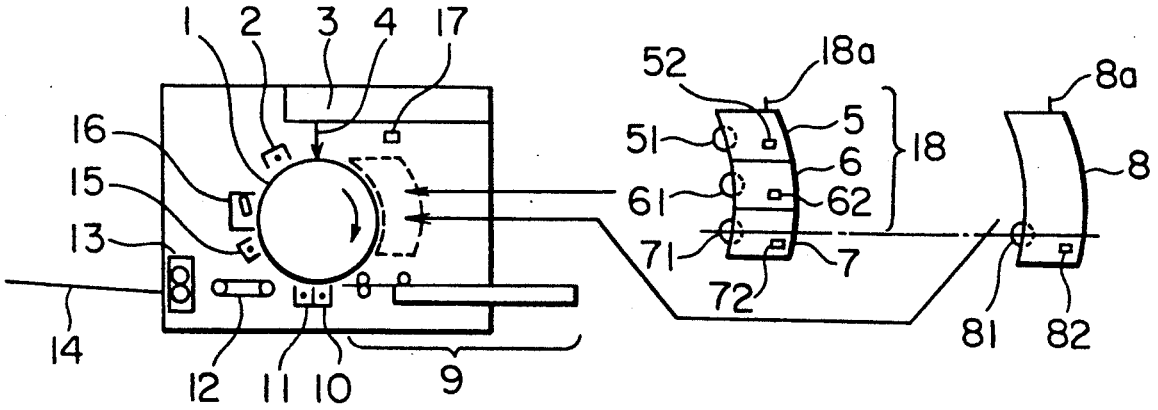

The image forming apparatus shown in FIG. 2 has developers 5, 6, and 7 integrated into unit 18. When this unit 18 is installed at the position enclosed with dotted lines, detection part **18*a* is detected by sensor 17 and the image forming apparatus enters color image forming mode. Moreover, when developer 8 containing black toner and having the contour identical to unit 18 is installed in place of unit 18, detection part 8*a* is detected by sensor 17** and the image forming apparatus enters mono-color image forming mode.

Image formation under the color image forming mode and mono-color image forming mode follows the same processes as image forming apparatus shown in FIG. 1. Since developer 8 in this image forming apparatus can hold much more black toner than the others, frequent replenishment of black toner becomes unnecessary.

Moreover, as FIG. 2 shows, the image forming apparatus configuration can be prevented from becoming too complex by the following: (1) Placing development sleeve 81 of black toner developer 8 at the same position as development sleeve position 71 of cyan toner developer 7, and making the two developers share the common use of sleeve drive mechanism; or/and (2) Placing the development bias connector sections (72 for cyan toner developer or 82 for black toner developer) at identical positions, and making both developers share the common use of development bias voltage supply unit. The black toner developer sleeve position may match those of other yellow and magenta toner developers. However in view of toner replenishment to the sleeve, it is better for the sleeve of the black toner developer to match that of cyan toner developer (or the developer positioned at the most downstream side).

Figure 3:
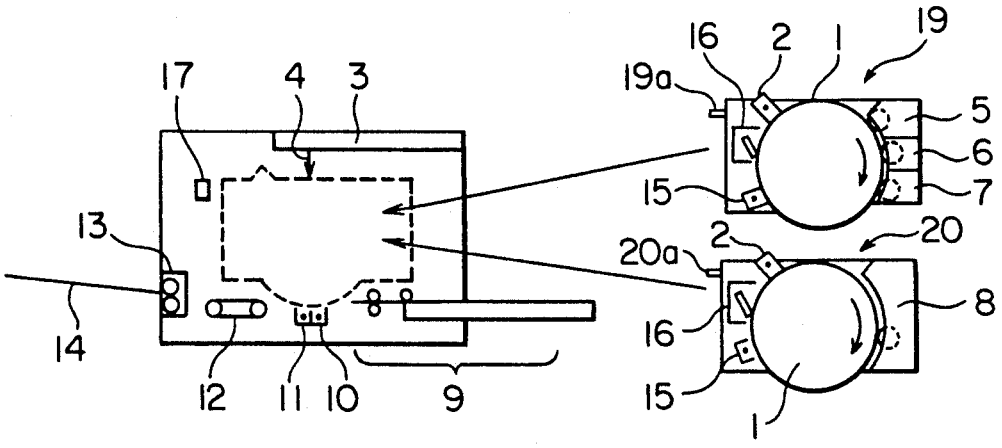

The image forming apparatus shown in FIG. 3 has photosensitive drum 1 and surrounding charger 2, developers 5 to 7 or developer 8, the pre-cleaning discharger 15, and cleaning unit 16 integrated into unit 19 or 20, and when unit 19 is installed at the position enclosed with the dotted line, detection part 19*a* is detected by sensor 17 and the image forming apparatus enters the color-image forming mode. If unit 20 is installed at the same position, detection part 20*a* is detected by sensor 17 and the image forming apparatus enters the mono-color image forming mode. This image forming apparatus, similar to the counterpart in FIG. 2, can provide the black toner developer with a larger toner capacity than the others, saving frequent replenishment of black toner.

Figure 4:
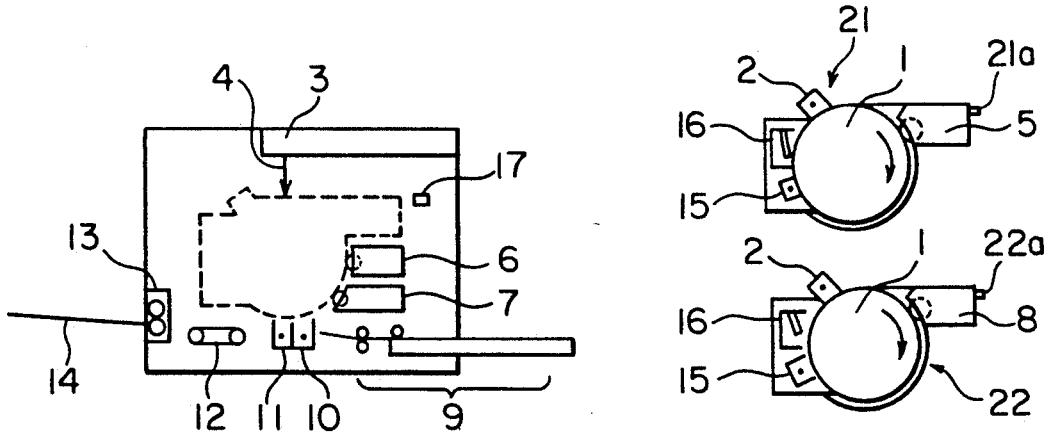

The image forming apparatus in FIG. 4 has photosensitive drum 1 and surrounding charger 2, developers 5 or 8, the pre-cleaning discharger 15, and the cleaning unit 16 integrated into the unit 21 or 22. When either unit 21 or 22 is installed at the position enclosed by the dotted line, their detection parts 21*a* or 22*a* are detected by sensor 17 and the image forming apparatus enters either the color image forming mode or the mono-color image forming mode having a mono-color development print function of either black, magenta, or cyan toner.

Preferred embodiments of the present invention described herein are illustrative and not restrictive. This invention may be practiced or embodied in still other ways without departing from the spirit or essential character thereof. For example, a component equivalent to developer 8 in FIG. 2 or a component equivalent to developer 8 of unit 20 in FIG. 3 may be installed with another developer having a red toner. If the mono-color image formation start button for black toner is depressed, a black image is formed, and if a mono-color image formation start button for red toner is depressed, a red image is formed.

In this case, the red toner developer may be installed on top of developer 8 with the black toner developer having double the toner capacity below, and the development sleeve for black toner may be matched to that of developer 7 of developer unit 18 shown in FIG. 2.

FIG. 1 to FIG. 4 show basic configurations in the exchange of developers.

Figure 5:
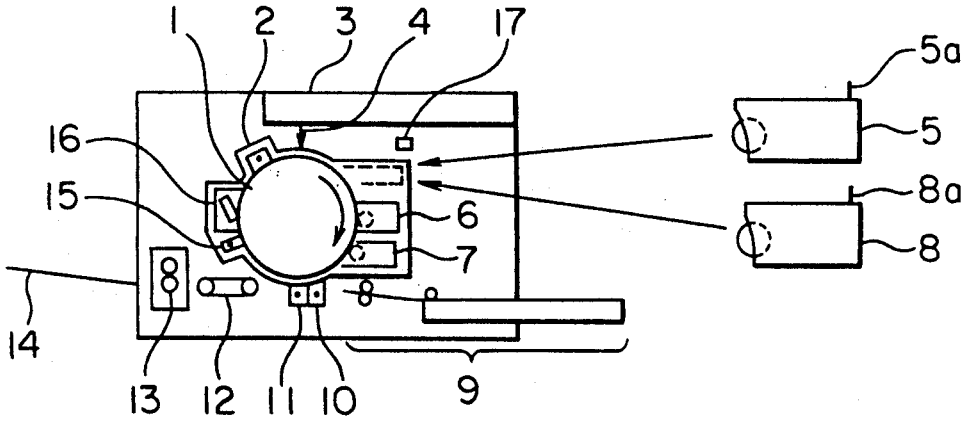
Figure 6:
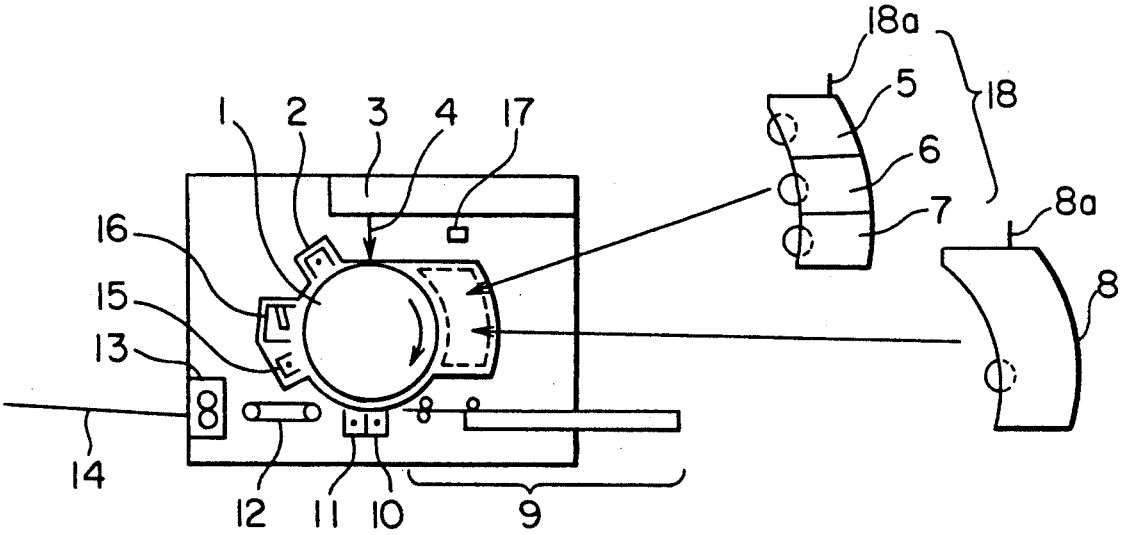
Figure 7:
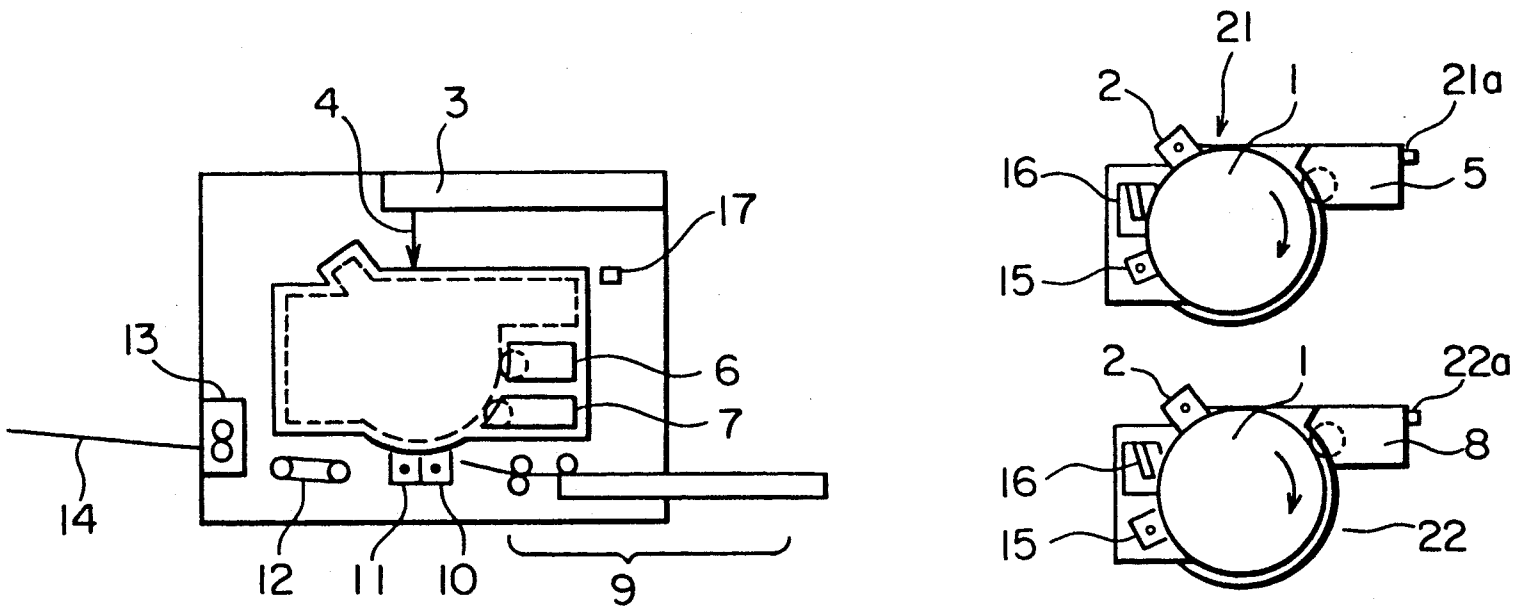

The exchange method at least together with the developer has other components such as the photosensitive drum for forming an image, the group of developers, the cleaning unit, electro-static charge electrode, and transfer separator electrode integrated into a process unit which is placed on the rack railing and can be fully pulled out for removal from the device. Alternatively, developers and units may be exchanged after they are pulled out once. FIGS. 5 to 7 show these configurations. (Thick solid line represents a process unit.)

FIG. 5 shows an image forming apparatus having electro-static charger 2, photosensitive drum 1, three developers (5, 6, 7, and 8), pre-cleaning discharger 15, and cleaning unit 16 of FIG. 1 integrated into a removable unit; developers 5 and 8 are interchangeable. FIG. 6 shows the image forming apparatus having electrostatic charger 2, photosensitive drum 1; three developers of FIG. 2 integrated into the unit 18, and pre-cleaning discharger 15 and cleaning unit 16 integrated into a removable unit; and developer unit 18 and developer 8 are interchangeable.

FIG. 7 shows an image forming apparatus having electro-static charger 2, the photosensitive drum 1, and three developers (5, 6, 7 or 8); pre-cleaning discharger 15 and cleaning unit 16 of FIG. 4 integrated into a removable unit; the subunit including developer 5 and one including the developer 8 are interchangeable.

The configurations shown in FIGS. 5 to 7 have more advanced component unitization and have improved maintainability for better usefulness.

In the above mentioned FIGS. 1 through 7, the developer drive and bias power supply for the development sleeve or at least the supply terminals from the bias power supply may be shared among developers, or the drive position of the development sleeve of mutually exchanged developers may be shared, or the sleeve position may be set up so as to share the means of bias voltage supply for development.

Examples in FIGS. 5, 6, and 7 indicate that developers in the process unit installed in the main body like a cartridge can be exchanged wholly or by a developer of individual toner color. If the frequency and volume of use differs by toner color, only the developer of a toner of large consumption can be exchanged.

Moreover, among the plural number of color toners, the image forming apparatus of the present invention enables the use of cyan toner of different specifications (such as fixing property, fluidity, and transmission). This is done by selecting the toner to match the service environment and the type of business. As a result, the color image forming apparatus according to the invention can reproduce specific colors that meet the needs of the market.

Figure 8:
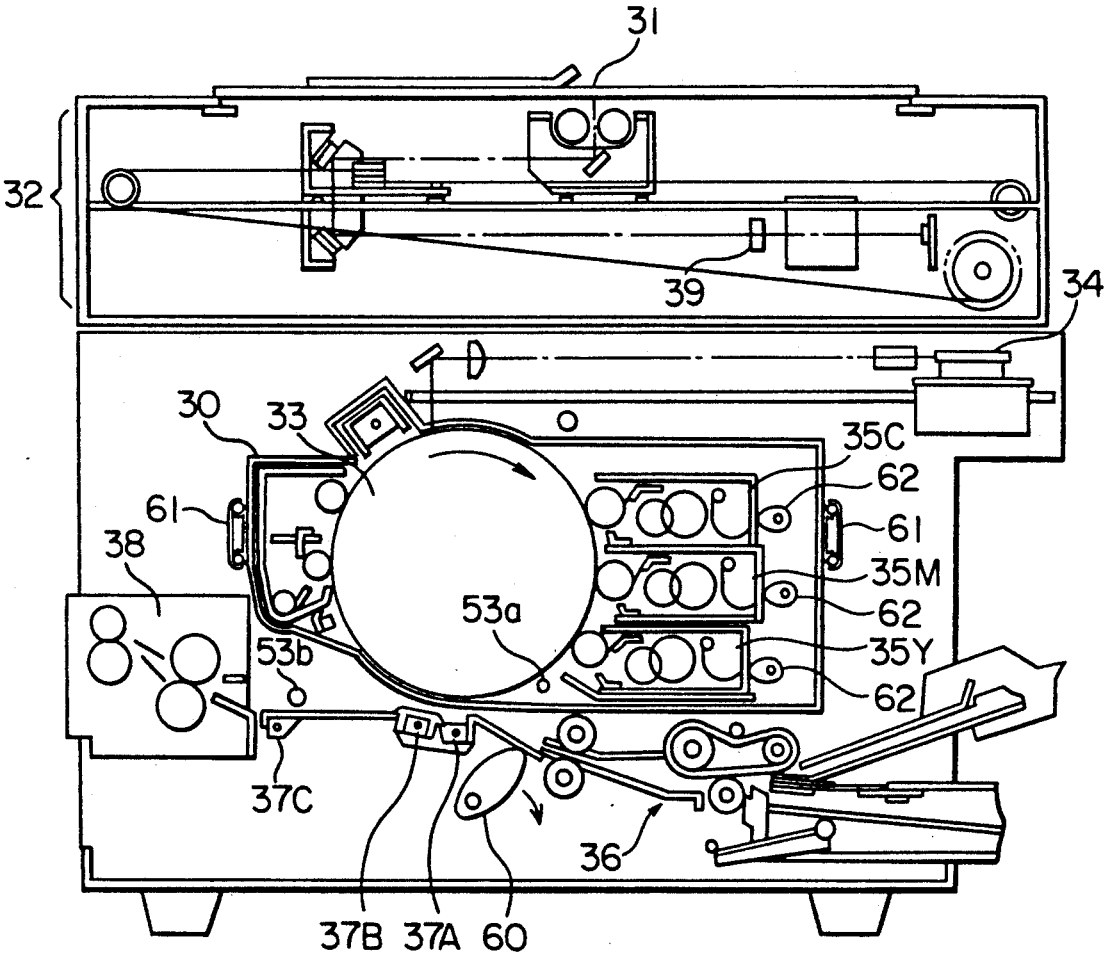

FIG. 8 shows an embodiment of the image forming apparatus with developer exchange of the present invention.

In FIG. 8, an original (not illustrated) placed on platen glass 31 is read by image reading unit 32. The image data of the original as read by image reading unit 32 is fed to semiconductor laser exposure unit 34 after being image-processed. Laser exposure unit 34 radiates photosensitive drum 33 with the image light rays modulated by the image data light of the original, thereby forming an electro-static image on the surface of photosensitive drum 33. The static image is changed to a toner image on the surface of photosensitive drum 33 by developer 35C, developer 35M, and developer 35Y.

Figure 11:
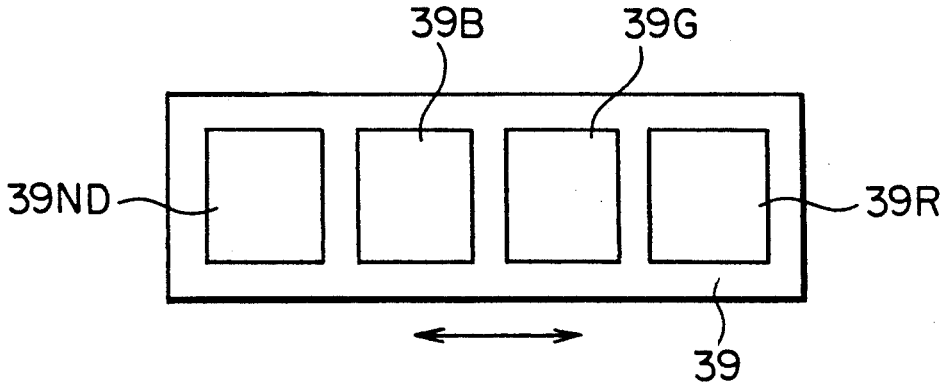

When image reading unit 32 reads the original placed on platen glass 31, the filter 39 performs color separation As FIG. 11 shows, filter 39 consists of filters 39G, 39B, and 39ND. The original is read through either one of filters 39R, 39G, 39B, or 39ND. Which filter to select, 39R, 39G, 39B, or 39ND is determined by moving filter 39 in the right and left-handed direction of FIG. 11 (or perpendicularly to the surface of paper in FIG. 1) using a filter selection unit 32*a* to be described later on. Filters 39R, 39G, and 39B respectively pass red, green, and blue light rays while the filter 39ND is a human neutral filter that passes all three colors.

The above is an image reading unit of the filter switching type; and in the image-reading unit which uses color separation by a prism or color sensor, it provides an image data subjected to color-correction in accordance with each color toner.

Developers 35C, 35M, and 35Y are loaded with cyan(C), magenta(M), and yellow(Y) colored toners respectively, and every rotation of photosensitive drum 33, a toner image of each yellow(Y), magenta(M), and cyan(C) is sequentially formed on photosensitive drum 33 upon exposure of respective image light rays by laser exposure unit 34.

The toner images thus formed are transferred by transfer unit 37 onto record paper (not illustrated) fed by paper feeder 36. Record paper having a transferred toner image is separated by separator electrode 37B, heat-fixed by fixing unit 38 before being ejected from the machine.

As FIGS. 1 to 7 show, the image forming apparatus of this embodiment has all or at least some of the photosensitive drum, developers, and cleaning unit fitted thereto the ted unit. FIG. 8 shows a configuration corresponding to the one in FIG. 1 wherein all of the above mentioned components are integrated into unit 30.

To remove unit 30 from the main body, cam 60 is moved to turn the part including the transfer electrode 37A and the separator electrode 37B around the shaft 37C, separating those electrodes from the unit 30 and, in particular, from photosensitive drum 33; unit 30 is pulled out in the direction of the axle of photosensitive drum 30 (perpendicular to the page FIG. 8 is printed on) along guide rails 61; then developers 35C, 35M, and 35Y are removed from the developing position using cam 62 so that they can be exchanged with other developers or with a black toner developer (not illustrated; a developer as shown by number 8 of FIG. 1) as a monocolor. It is, of course, possible to replace the entire process unit 30 with other process units, as shown in FIG. 3.

Figure 9:
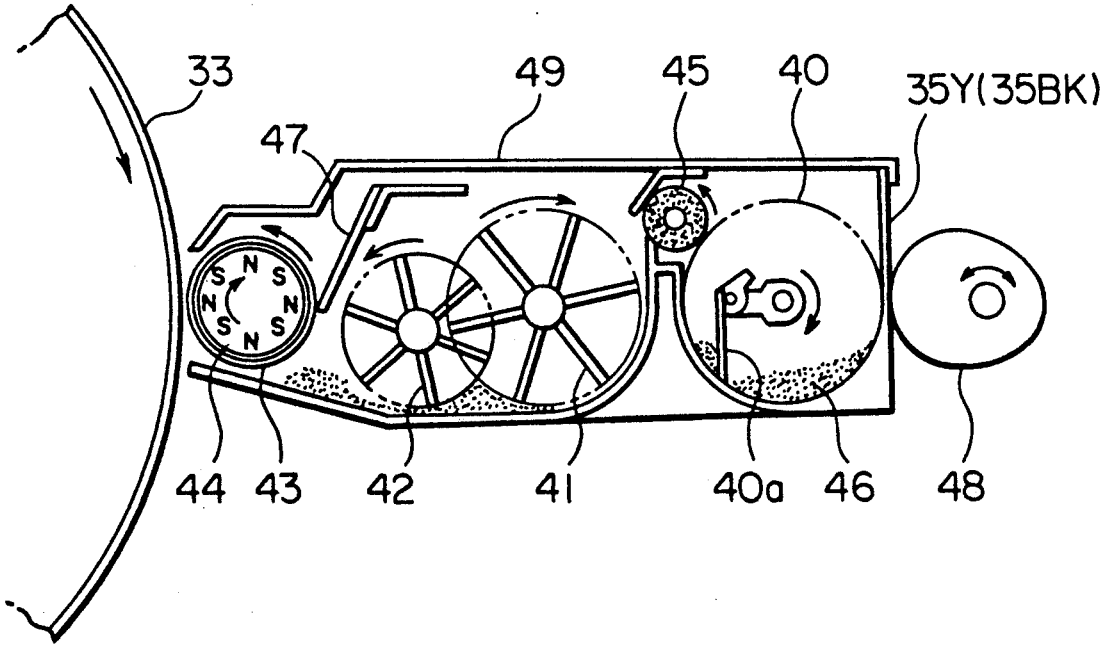

The main body of developers 35C, 35M, 35Y, and 35BK to be described later on is configured as shown in FIG. 9 though it shows only developers 35Y and 35BK as representative. In FIG. 9, toner storage unit 40, stirrer vanes 41, and 42, development sleeve 43, magnet roll 44, and toner feeder roller 45 are installed inside developer 35Y. Lid 49 is installed on top of developer 35Y to prevent toner from scattering by covering toner storage unit 40, stirrer vanes 41 and 42, development sleeve 43, magnet roll 44, and toner feeder roller 45 inside. Moreover, the clearance between development sleeve 43 and photosensitive drum 33 is maintained by a roller (not illustrated) which is coaxially fitted around development sleeve 43 and comes in contact with photosensitive drum 33.

Toner 46 is deposited at the bottom of toner storage unit 40, and it is scooped in the upper leftward direction, as shown in FIG. 9, by the clockwise rotation of scooper plate 40*a*. Toner 46 scooped up by scooper plate 40*a* is shifted in the leftward of FIG. 9 by the rotation of toner feeder roller 45 to be fed to stirrer vane 41. Stirrer 41 together with stirrer 42 stirs toner 46 with the magnetic carrier and the two-component developing agent consisting of magnetic carrier and toner 46 which are attached to development sleeve 43 by the anticlockwise rotation of stirrer vane 42. Magnet roll 44 rotates inside development sleeve 43, and a magnetic brush is formed with the above-mentioned developing agent by development sleeve 43 and magnet roll 44.

A thin layer of the developing agent is formed on the surface of development sleeve 43 by the magnetic brush and the thickness of the thin layer is adjusted by brush-cutter plate 47 to enable a thinner layer than a clearance between development sleeve 43 and photosensitive drum 33. Toner 46 flies to a latent electro-static image on photosensitive drum 33 from the surface of a thin layer of developing agent by AC bias voltage and the latent electro-static image on the surface of photosensitive drum 33 is developed into a toner image.

During the development process, a bias voltage consisting of DC and AC components is applied to development sleeve 43, and by controlling this bias voltage, the fluctuation of developing conditions that occur, when developers 35Y and 35BK are exchanged, is adjusted.

FIG. 8 shows that after moving away the transfer and separator system including a part of feeding system by rotating the eccentric cam 60 in the direction of the arrow, the process unit set on the rail shown with a thick solid line can be pulled out.

Moreover, developer 35Y in FIG. 8 can be exchanged with developer 35BK containing black(BK) toner to provide a sharp monochromatic image; developer 35Y is exchanged with developer 35BK to develop the image with a black toner when making a development copy of a monochromatic image.

Developer 35BK is configured identically to developer 5Y as shown in FIG. 9. This enables sharing among different developers of the developer drive and the bias power supply to apply to the development sleeve.

Exchange of developer 35Y with developer 35BK starts by turning clockwise eccentric cam 48 which is installed to the right-hand side of developer 35Y (see FIG. 9). As a result of rotating the eccentric cam 48, developer 35Y is released from the fixed state and it is pulled out toward user (in the perpendicular direction to the page FIG. 1 is printed on).

Then, developer 35Y is removed and developer 35BK is inserted in a vacant space by moving it away from user perpendicularly to the page FIG. 8 is printed on. When developer 35BK reaches the fixed position and insertion is completed, it is fixed by turning the above mentioned eccentric cam counterclockwise. This completes the exchange of developers 35Y and 35BK.

To obtain a full-color image, the same procedure is carried out as was used for the exchange of developers 35Y and 35BK; namely, developer 35BK is replaced with the developer 35Y.

Since the toner exchange between developer 35Y and developer 35BK is made, as described above, in the state wherein toner storage unit 40 is internally installed and developers are covered by lid 49, user will not soil his hands with toner and toner can be exchanged easily. The exchange of toner (or exchange of developers) between developers 35Y and 35BK is detected by developer sensing circuit 50 as shown in FIG. 10.

Figure 10:
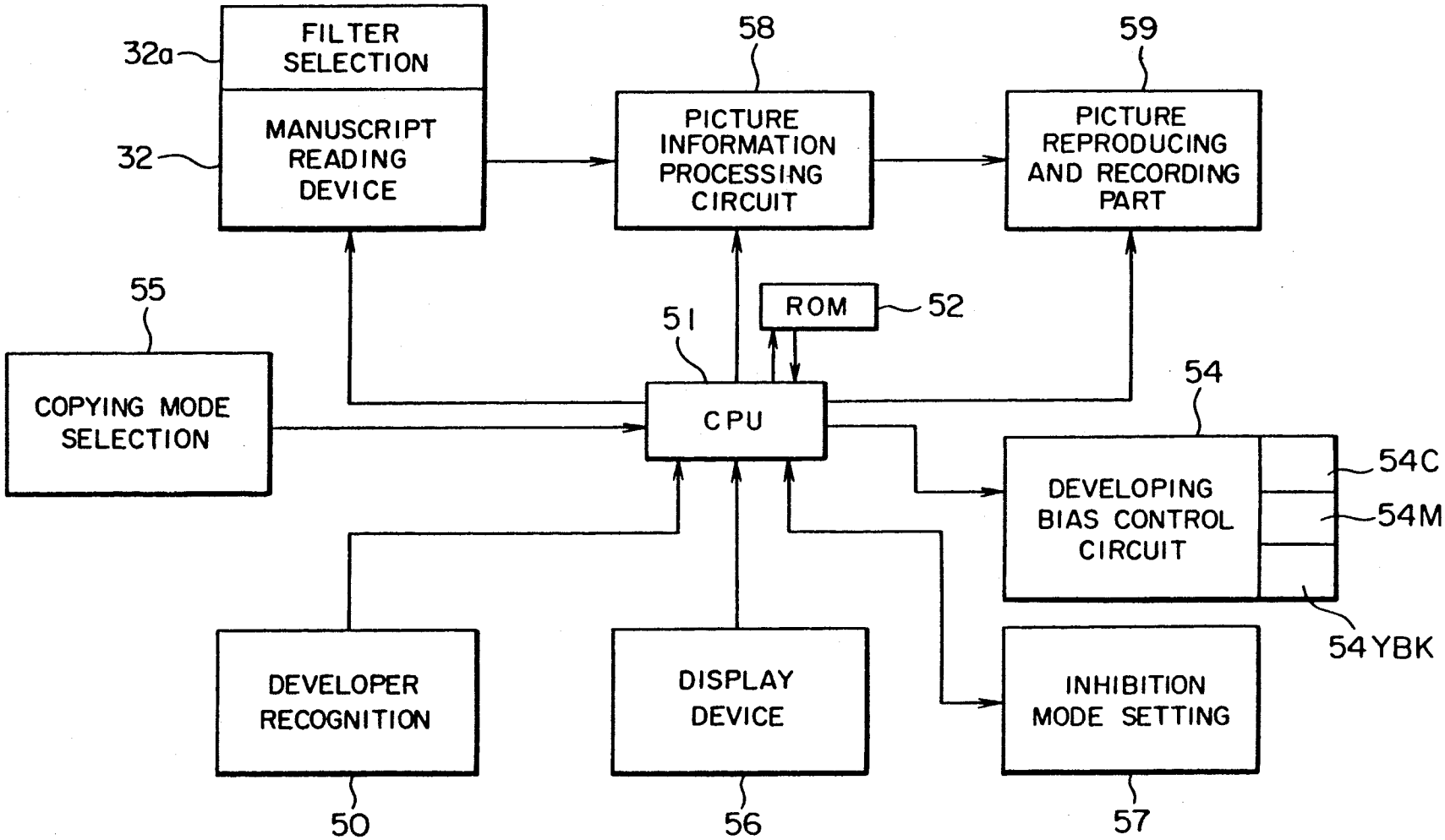

In FIG. 10, the developer sensing circuit 50 is configured as a microswitch or photocoupler that detects a protrusion (not illustrated) formed as a part of the cabinet for developers 35Y and 35BK. That is, developer sensing circuit 50 discriminates the developers 35Y and 35BK from each other according to the shape (presence) of protrusions.

The result of judgement made by the developer sensing circuit 50 is fed to CPU circuit 51. CPU circuit 51 upon receipt of this judgement outputs instructions to image reading unit 32, inhibition set-up circuit 57, image information processing circuit 58, and image reproduction record 59.

CPU circuit 51 reads the reference development bias values (for example, DC and AC voltages) stored in ROM52 in advance and feeds the data to development bias control circuits 54C, 54M, and 54YBK.

Development bias control circuits 54C and 54M respectively sets up bias voltage to be applied to developers 35C and 35M. Moreover, development bias control circuit 54YBK is shared by developers 35Y and 35BK and sets up the bias voltage to be applied to development sleeve 43 of either developer 35Y or 35BK which is currently installed in the apparatus, according to the optimum development bias value supplied by CPU circuit 51.

Development bias control circuits 54C, 54M, and 54YBK set up the bias voltage to apply to development sleeve 43 according to the reference development bias value supplied by CPU circuit 51, and a latent reference image is developed tentatively according to this reference development bias value.

Consecutively, CPU circuit 51 detects with sensor 53*a* or 53*b* the reflection density of color toner image obtained by developing the latent reference image developed according to the reference development bias value. The detected reflection density is compared with the reference development bias value stored in advance with ROM52, and if they do not match, the address on ROM52 is calculated on the basis of difference between the reflection density detected by either sensor 53*a* or 53*b* and the reference reflection density at the reference development bias value, and the optimum development bias voltage is read from ROM 52.

Then, CPU circuit 51 feeds the optimum development bias voltage read from ROM 52 to development bias control circuits 54C, 54M, and 54YBK. Development bias control circuits 54C, 54M, and 54YBK respectively set up the bias voltage to apply to individual development sleeve 43 according to the optimum development bias value supplied by CPU circuit 51, and thereafter the development is performed according to this optimum development bias value. On the other hand, the optimum development bias value is applied to control toner density of developing agent.

Moreover, sensors 53*a* and 53*b* described above are installed around photosensitive drum 33 as shown in FIG. 8. Sensor 53*a* detects the reflection density of toner attached to photosensitive drum 33, and the sensor 53*b* detects the reflection density of toner attached to the recording paper.

When developers 35Y and 35BK are exchanged as stated above, the bias voltage to apply to the development sleeve 43 is automatically reset by the development bias voltage, adjusting any fluctuation of developing conditions that occur when developers 35Y and 35BK are exchanged.

An instruction is output to image reading unit 32 for selecting either filter 39G or 39B. Moreover, if developer 35BK is set to the device (that is, when producing monochromatic image), image reading unit 32 is instructed to set up filter 39ND.

To inhibition mode set-up circuit 57, a set-up signal is output to inhibit respective operations of image reading unit 32, photosensitive drum 33, image exposure unit 34, and developer 35, etc., providing the specific developer 35 of the inhibition mode among the image forming modes is set to the device.

With the exchange of developers 35Y and 35BK, the image forming mode will be changed as follows:

| (a) If developers 35C, 35M, and 35Y are used: | |
|---|---|
| Color mode (Y, M, C): | Usable |
| Mono-color mode (B, G, R): | Usable |
| Mono-color mode (Y): | Usable |
| Mono-color mode (BK): | Usable |
| Mono-color mode (M, C): | Usable |
| (b) If developer 35BK is used: | |
| Color mode (Y, M, C): | Not usable |
| Mono-color mode (B, G, R) | Not usable |
| Mono-color mode (Y): | Not usable |
| Mono-color mode (BK): | Usable |
| Mono-color mode (M, C): | Usable |

The color mode (Y, M, C) refers to a mode for forming a color toner image using developers 35C, 35M, and 35Y, and the monocolor mode (B, G, R) refers to a mode for forming a mono-color by laying over any two colors of toner from developers 35C, 35M, and 35Y against an identical latent image. Moreover, the mono-color mode (BK) refers to both cases where a mono-color (black) is formed by combining three colors of toner from developers 35C, 35M, and 35Y and where a mono-color (black) is formed singularly using developer 35BK. Furthermore, the mono-color mode (Y, M, C) refers to a mode for forming a mono-color by using any one of toner from developers 35C, 35M, and 35Y. A multi-color mode may be added to the above by using the combination of developers 35BK, 35M, and 35C where a color area specified by an editor can be output using two or three colors of black, magenta, and cyan with two to three rotations of the photosensitive drum. Moreover, the development bias is controlled by the development bias control circuit (FIG. 10) in correspondence with the image forming mode.

If a user selects an image forming mode from among these usable modes by operating copy mode specifying circuit 55, the selected image forming mode is displayed by display unit 56 to verification. Furthermore, if a user should select an unusable mode, inhibition set-up circuit 57 is ,actuated to inhibit respective operations of image reading unit 32, photorespective sensitive drum 33, laser exposure unit 34, developer 35, and others.

If developer 35BK is installed on the apparatus, the setting motion of developer 35BK is designed to automatically select green filter 39G or neutral filter 39ND, thus saving the filter exchange operation and contributing to improved operability.

CPU circuit 51 outputs instructions to image information processing circuit 58 and image reproduction record 59 as follows; CPU circuit 51 reads image forming modes stored in advance with ROM 52 of the address corresponding to the detection result by developer sensing circuit 50 and feeds the data to the image information processing circuit 58 and image reproduction record 59.

At this time, the image forming mode information fed by CPU circuit 51 to image information processing circuit 58 and to image reproduction record 59 gives priority to the color mode setting if the developer exchange is made from developer 35BK to 35Y, and if the is from developer 35Y to 35BK, CPU circuit 51 gives priority to the mono-color mode setting in black.

Image information processing circuit 58 and image reproduction record 59 control the device in the mode as specified.

Moreover, while .the embodiment has been thus far described specifically relating to the case where developers 35Y and 35BK are exchanged mutually, image forming modes can be set up similarly where developers are exchanged by mutually shifting developers 35C, 35M, 35Y, and 35BK to the right-hand side, as shown in FIG. 8, for removal from the apparatus.

The exchange of developers can be realized, in addition to the above method, by having the image developing body and the group of developers integrated into a unit mounted on the rack railing, and changing the developers after pulling out this unit once. In this case, the developers may be configured so as to enable them to removed directly from said unit. Moreover, the position of the developer to be exchanged is not restricted to the lowest position; it can be positioned on the top or in the middle of the developers.

What is claimed is:

1. An image forming apparatus, comprising a photosensitive body, an electrostatic charger adjacent the photosensitive body, an image exposure means for forming on a charged surface of the photosensitive body an electrostatic image corresponding to signals representing a particular image, multiple developing means having respective multiple color toners to produce a toner image for the electrostatic image obtained with the image exposure means for at least one color of the multiple color toners, and a transfer means for transferring the toner image onto a transfer material; said multiple developing means comprising a plurality of first developing means placed in an installed position for respectively storing the multiple color toners, second developing means for storing a black toner, and means for selectively placing the second developing means in the installed position of at least one of said plurality of first developing means.

2. An image forming apparatus as recited in claim 1, wherein said plurality of first developing means are individual units that respectively store toners Y, M, and C, and one of which is replaceable in its installed position with the second developing means containing black toner.

3. An image forming apparatus as recited in claim 1, wherein said plurality of first developing means respectively storing the toners Y, M, and C are integrated into a unit, said unit being replaceable with the second developing means containing black toner.

4. An image forming apparatus recited in claim 1, wherein said photosensitive body and at least one of the plurality of first developing means are integrated into a unit, said unit being replaceable with another unit integrating another such photosensitive body and the second developing means storing black toner.

5. An image forming apparatus as recited in claim 1, further comprising means for automatically selecting a specific image forming mode set in advance for each of the first and second developing means to be actuated with placement of the respective first and second developing means in the installed position.

6. An image forming apparatus as recited in claim (5), further comprising means, actuated when power is applied to the image forming apparatus to turn it on, for setting a specific image forming mode which is the most frequency used mode for whichever one of the first and second developing means is being used.

7. An image forming apparatus as recited in claim (5), wherein said means for automatically selecting specific image forming mode changes to a color mode when the second developing means is replaced in the installed position with the first developing means containing yellow, magenta, and cyan toner.

8. An image forming apparatus as recited in claim (5), wherein said means for automatically selecting a specific image forming mode changes to a mono-color image forming mode when the first developing means is replaced with the second developing means containing black toner.

9. An image forming apparatus as recited in claim 1, wherein a unit comprising at least said plurality of the first developing means for developing an electro-static image on the photosensitive body and is exchangeable with the second developing means containing only black toner, and means for inhibiting the selection of the color image forming mode being actuated with a setting motion of the second developing means containing the black toner.

10. An image forming apparatus comprising an image reading means for reading an original image through a filter means for color separation and for converting the thus filtered image to image information to produce output data, and a plurality of units each of which includes a developing means for developing an electrostatic image formed on a photosensitive body by the output data of the image reading means, the developing means of one of said plurality of unit shaving a black toner, and the developing means of another of said plurality of units having at least one color toner, means to produce motion for installing said one unit in place of said another unit, means for determining when said one unit having the developing means including the black toner is installed in place of said another unit, and means for setting a green or a neutral portion of said filter by the motion that installs said one unit in place of said another unit.

11. An image forming apparatus as recited in claim 1, wherein said apparatus further comprises means for selecting green or neutral data of said signals to produce said electrostatic image when said second developing means is installed.

12. An image forming apparatus comprising a color image reading means for reading an original image through a filter means for color separation and for converting the thus filtered image to image information to produce color output data, and a plurality of units each of which includes a developing means for developing an electro-static image formed on a photosensitive body by the color output data of the color image reading means, the developing means of one of said plurality of units having a black toner, and the developing means of another of said plurality of units having at least one color toner, means to produce motion for installing said one unit in place of said another unit, means for determining when said one unit having the developing means including the black toner is installed in place of said another unit, and means for selecting green or neutral data of said image information by the motion that installs said one unit in place of said another unit.

* * * * *